US012616341B2

(12) United States Patent
Short

(10) Patent No.: US 12,616,341 B2
(45) Date of Patent: May 5, 2026

(54) WEIGHTED DEVICE FOR BUOYANCY PREVENTION AND A METHOD FOR USE THEREOF

(71) Applicant: Wendi Short, San Marcos, TX (US)

(72) Inventor: Wendi Short, San Marcos, TX (US)

( * ) Notice: Subject to any disclaimer, the term of this patent is extended or adjusted under 35 U.S.C. 154(b) by 0 days.

(21) Appl. No.: 18/233,683

(22) Filed: Aug. 14, 2023

(65) Prior Publication Data

US 2024/0065488 A1 Feb. 29, 2024

Related U.S. Application Data

(60) Provisional application No. 63/401,351, filed on Aug. 26, 2022.

(51) Int. Cl.
*A47K 3/00* (2006.01)

(52) U.S. Cl.
CPC ..... *A47K 3/001* (2013.01)

(58) Field of Classification Search
CPC ..... A47K 3/001; B63C 11/30
See application file for complete search history.

(56) References Cited

U.S. PATENT DOCUMENTS 3,988,020 A * 10/1976 Carter ..... A63B 69/12 482/55
4,440,525 A * 4/1984 Perla ..... B63C 11/30 224/664
4,519,783 A * 5/1985 Burke, Jr. ..... A63B 69/12 441/24
4,752,263 A * 6/1988 Pritchard ..... B63C 11/02 128/202.14
4,778,307 A * 10/1988 Faulconer ..... B63C 11/08 441/106
4,990,115 A * 2/1991 Vorhauer ..... B63C 11/08 D21/805
4,993,980 A * 2/1991 Dulin ..... A61H 37/005 441/106
5,076,575 A * 12/1991 Eylander ..... A63B 21/065 482/139
5,205,672 A * 4/1993 Stinton ..... B63C 11/30 405/186
5,346,419 A * 9/1994 Kaiser ..... B63C 11/08 441/96
5,356,325 A * 10/1994 Awbrey ..... B63C 9/135 441/120
5,363,790 A * 11/1994 Matsuoka ..... B63C 11/08 405/186
5,451,121 A * 9/1995 Seligman ..... B63C 11/08 441/106
5,562,513 A * 10/1996 Kaiser ..... B63C 11/08 405/186
5,607,258 A * 3/1997 Eungard ..... B63C 11/2245 441/106

(Continued)

*Primary Examiner* — William L Miller
(74) *Attorney, Agent, or Firm* — Malcolm Pipes

(57) ABSTRACT

A weighted device for use by a user to prevent buoyancy is described. The weighted device includes a container formed of a meshed material, the container comprising at least one compartment. The weighted device also includes one or more pellet bags having a respective weight, the one or more pellet bags being disposed within the compartment of the container. The weighted device also includes fastening means configured to secure the container to a body part of the user.

10 Claims, 8 Drawing Sheets

(56) References Cited

U.S. PATENT DOCUMENTS 5,803,667 A * 9/1998 Seligman ..... B63C 11/30 405/185
5,860,769 A * 1/1999 Seligman ..... A44B 11/263 224/264
6,120,213 A * 9/2000 Stinton ..... B63C 11/08 405/186
6,146,053 A * 11/2000 Nelson ..... B63C 11/30 224/664
6,341,921 B1 * 1/2002 Anderson ..... B63C 11/08 441/106
6,881,011 B1 * 4/2005 Carmichael ..... B63C 11/30 405/186
8,516,633 B2 * 8/2013 Dobin ..... A47G 9/0246 24/387
12,304,601 B2 * 5/2025 Godoy ..... B63C 11/30
12,448,096 B2 * 10/2025 Goldsmith ..... B63C 11/30
12,466,527 B1 * 11/2025 Matko ..... B63C 11/08
2005/0050697 A1 * 3/2005 Wu ..... B65D 90/08 24/389
2005/0287889 A1 * 12/2005 Stenglein ..... B63C 9/135 441/120
2006/0101625 A1 * 5/2006 Okot ..... A44B 19/26 24/436
2006/0137147 A1 * 6/2006 Wihlborg ..... A44B 19/265 24/415
2007/0099774 A1 * 5/2007 Bruback ..... B63C 11/30 482/105
2007/0214614 A1 * 9/2007 Okot ..... A44B 19/265 24/432
2012/0102646 A1 * 5/2012 Chen ..... A44B 19/22 112/475.17
2012/0261083 A1 * 10/2012 Daly ..... A47H 23/02 160/368.1
2014/0082895 A1 * 3/2014 Gold ..... A44B 19/26 24/415
2019/0054334 A1 * 2/2019 Ventura ..... A63B 23/03575
2023/0098142 A1 * 3/2023 Bassoo ..... A63B 21/4007 482/105
2023/0302341 A1 * 9/2023 Cardoso ..... A63B 21/0557

* cited by examiner

WEIGHTED DEVICE FOR BUOYANCY PREVENTION AND A METHOD FOR USE THEREOF

CROSS-REFERENCE TO RELATED APPLICATIONS

The instant application claims the benefit U.S. Provision Application Ser. No. 63/401,351 entitled "A Weighted Device for Buoyancy Prevention and a Method for Use Thereof" filed on Aug. 26, 2022.

BACKGROUND OF THE INVENTION

1. Field of the Invention

The present invention relates to weighted devices and more specifically weighted belts used to prevent floating in water and buoyancy.

2. Description of Related Art

Generally, people make use of hot tubs for various reasons such as stress relief, muscle relaxation, improved sleep, pain relief, and even for burning calories. People tend to fill the hot tub with a suitable level of water and sit partially submerged in the water. For example, people may sit with their legs submerged in the water. In other examples, people may sit with their waist submerged in water.

Water tends to apply a buoyant force on a body causing the body to be pushed generally upwardly. When a person desires to sit in a hot tub of water, the water would apply a buoyant force on the body part of the person submerged in the water. This leads to a person being uncomfortable in sitting in water as the person has to work to stay in position against the buoyant force of water. This is inconvenient for the person, in particular, for a person suffering from pain, such as back pain. Conventionally known devices do not efficiently prevent buoyancy. For instance, scuba weight belts are too rigid and uncomfortable to wear specially for those suffering from pain.

Accordingly, there is an established need for a solution to the problems mentioned above. For instance, there is an established need for a weighted device that can be conveniently used by a person. Further, there is an established need for a weighted device that prevents buoyancy and floating when used by a person partially submerged in water. Further, there is an established need for a weighted device that allows a person to choose and balance weight thereof as per the requirements.

BRIEF SUMMARY OF THE INVENTION

The weighted device comprises a container formed of a meshed material, the container comprising at least one compartment. The weighted device further comprises one or more pellet bags having a respective weight, the one or more pellet bags being disposed within the compartment of the container. The weighted device further comprises fastening means configured to secure the container to a body part of the user.

In an aspect, the container comprises a single compartment.

In an aspect, the container comprises a plurality of compartments.

In an aspect, the container is formed of a double mesh structure.

In an aspect, the one or more pellet bags each comprise weights in the form of pellets.

In an aspect, the fastening means is a strap or belt with a hook and loop closure system on the ends of the strap or belt.

In an aspect, the container comprises a top portion at least partially detachable to a central portion.

In an aspect, the weighted device comprises a zipper configured to couple the top portion to the central portion.

In an aspect, the present invention relates to a method for using the weighted device by a user to prevent buoyancy. The method comprises providing a weighted device having a container formed of a meshed material, the container comprising at least one compartment. The method further comprises providing one or more pellet bags having a respective weight. The method further comprises placing the one or more pellet bags within the compartment of the container. The method further comprises securing the weighted device to a body part of the user by virtue of fastening means provided at the container.

In an aspect, the present invention relates to a kit comprising a container formed of a meshed material and a plurality of pellet bags, each of the pellet bags having an individual weight.

These and other objects, features, and advantages of the present invention will become more readily apparent from the attached drawings and the detailed description of the embodiments and examples, which follow.

DEFINITION LIST

Figure 1:
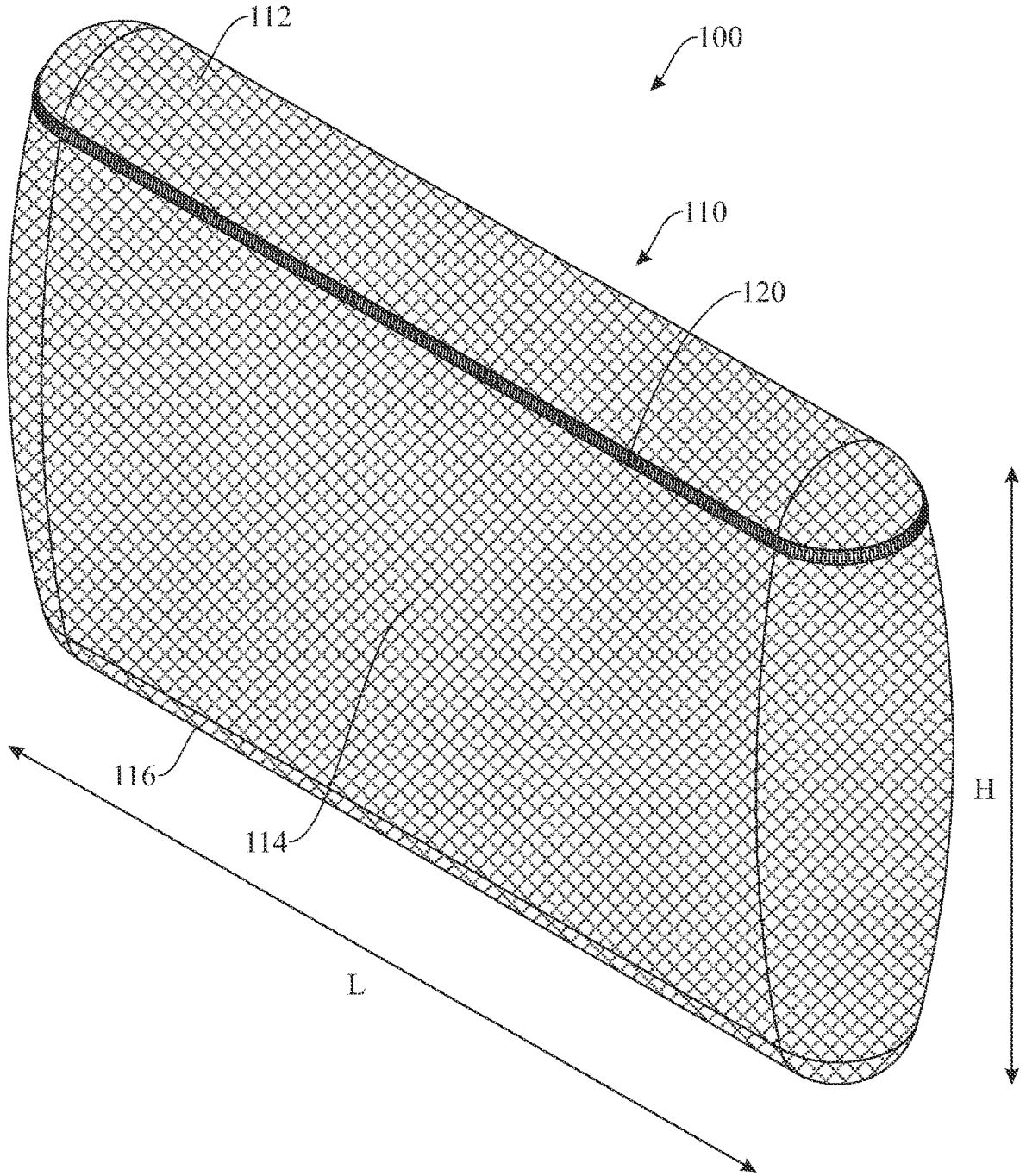
FIG. 1 is a front perspective view of a weighted device, in accordance with an embodiment of the present specification.

| Term | Definition |
|---|---|
| 100 | Weighted Device |
| 110 | Container |
| 112 | Top Portion of Container |
| 114 | Central Portion of Container |
| 116 | Bottom Portion of Container |
| 120 | Zipper |
| 130 | Fastening Means |
| 132 | Hook Portion of Hook and Loop Attachment System |
| 134 | Loop Portion of Hook and Loop Attachment System |
| 140 | At Least One Compartment |
| 140A | First Compartment |
| 140B | Second Compartment |
| 140C | Third Compartment |
| 145 | Compartment Divider |
| 150 | Pellet Bag |
| 160 | User/Person |
| 170 | Hot Tub |

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well known elements associated with weighted bags have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

Figure 2:
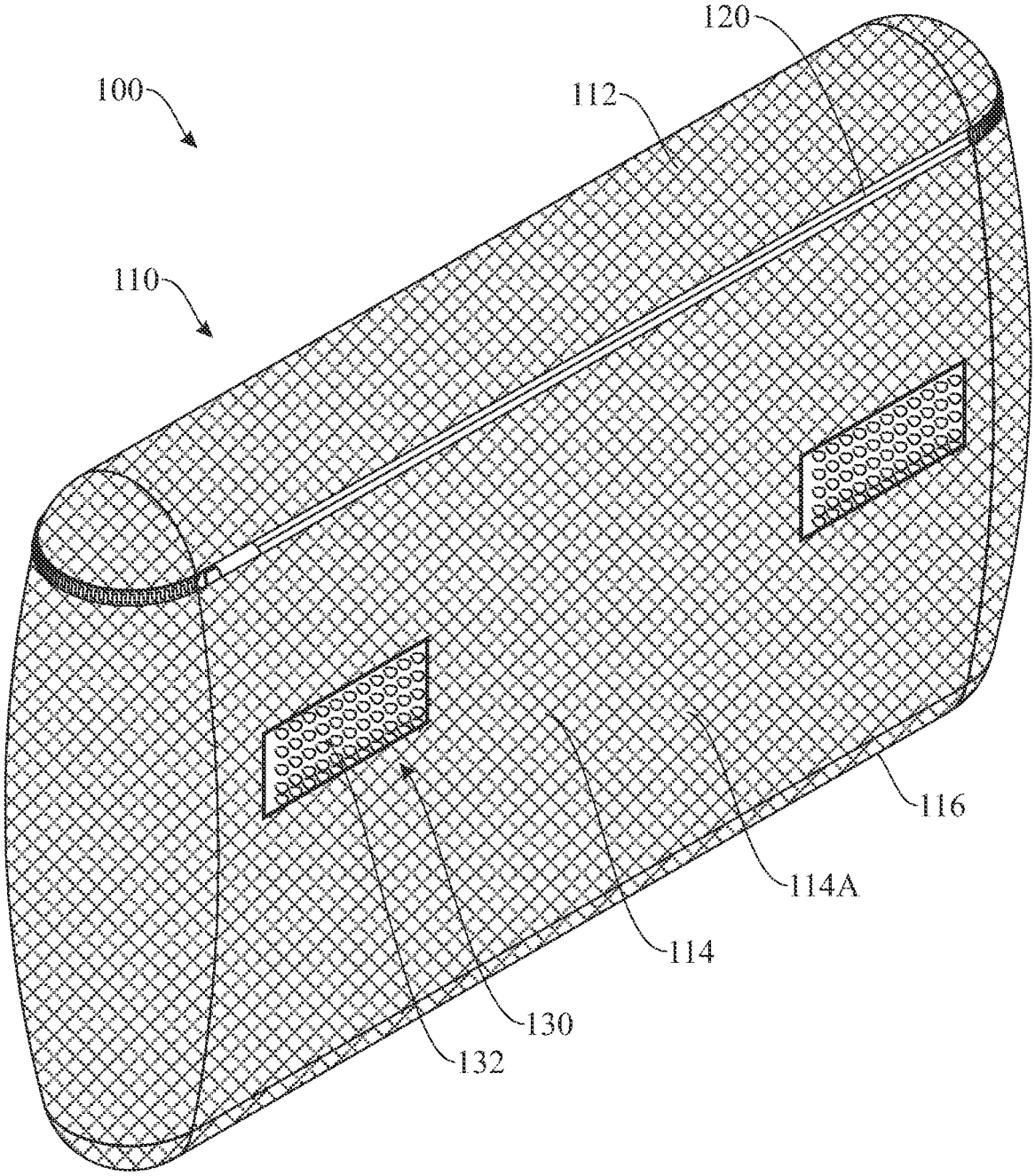
FIG. 2 is a rear perspective view of the weighted device, in accordance with an embodiment of the present specification.

Reference is initially made to FIGS. 1-2 that illustrates perspective views of a weighted device 100. FIG. 1 illustrates a front perspective view of the weighted device 100 while FIG. 2 illustrates a rear perspective view of the weighted device 100. In the illustrated embodiments, the weighted device 100 takes the form of a meshed bag that allows one or more components to be placed therein, as will be detailed further below. The weighted device 100 is configured for use by a user in order to prevent buoyancy and/or floating when the user is at least partially submerged in water. Weighted device is used to hold the user down onto the hot tub seat, bench, or floor wherein the user's face is kept above water. Weighted device is not used to hold the user's whole body and face under water.

The weighted device 100 comprises a container 110 formed of a meshed material. Container 110 is essentially a pocket, envelope, bag, or sack made of strong, flexible, meshed material. Container 110 has a left side, an upper side, a lower side, a right side, an inside surface, and an outside surface. In some modes, container 110 has a left longitudinal seam running parallel to and adjacent to the left side of the container 110. Left longitudinal seam may run all the way around the container 110. In some modes, container 110 has a right longitudinal seam running parallel to and adjacent to the right side of the container 110. Right longitudinal seam may run all the way around the container 110. In some modes, container 110 has a lower longitudinal seam running parallel to and adjacent to the lower side of the container 110. Lower longitudinal seam may run all the way around the container 110. Left longitudinal seam, right longitudinal seam, and lower longitudinal seam are each seams resulting from the sewing and forming of the pocket, envelope, bag, or sack that is the container 110.

The container 110 has a top portion 112, a central portion 114, and a bottom portion 116. In some embodiments, each of the top portion 112, the central portion 114, and the bottom portion 116 is formed of a meshed material. Accordingly, the container 110 allows fluid communication there through of a liquid, such as water, by virtue of the meshed material. Container 110 is made of material(s) that will not damage the finish of a hot tub 170. Any known strong, flexible, meshed material may be used to construct container 110.

In some embodiments, the meshed material may be nylon, neoprene, waterproof polyurethane, Dyneema®, polyurethane laminate, polyester, Silnylon, plastic, polymer, canvas, cotton, and/or derivatives thereof. It is appreciated that the above-noted materials are not limiting, and other materials may be used to form the weighted device 100. In some embodiments, the container 110 may be formed of a double-mesh structure. In some embodiments, the meshed material may be of any suitable color.

In some embodiments, the weighted device 100 has a length L and a height H, as shown in FIG. 1. In some embodiments, the length L is about 8 inches, and the height H is about 6 inches. In some embodiments, the length L is about 10 inches, and the height H is about 8 inches. In some embodiments, the length L is about 11 inches, and the height H is about 9 inches. In some embodiments, the length L is about 12 inches, and the height H is about 10 inches. In some embodiments, the length L is about 15 inches, and the height H is about 12 inches. In some embodiments, the length L is about 16 inches, and the height H is about 14 inches. It is appreciated that the above-noted dimensions are not limiting, and the weighted device 100 having other dimensions may be utilized without departing from the scope of the invention. The term 'about' as used herein is meant to encompass deviation of 10% from the specifically mentioned value of a parameter, such as length and height.

Figure 4:
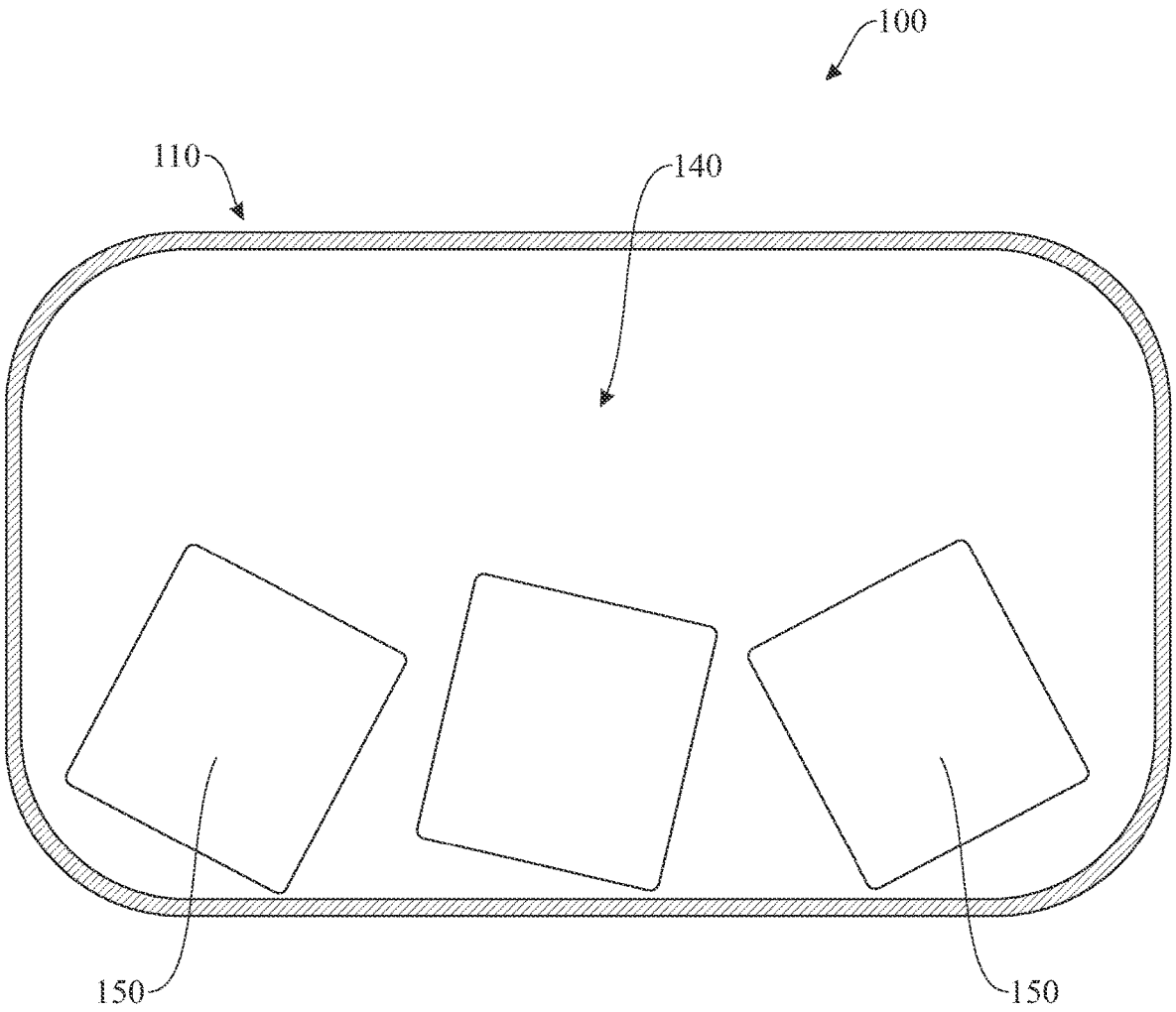
FIG. 4 is a cross sectional view of weighted device with a single compartment comprising a plurality of pellet bags, in accordance with one embodiment of the present specification.
Figure 5:
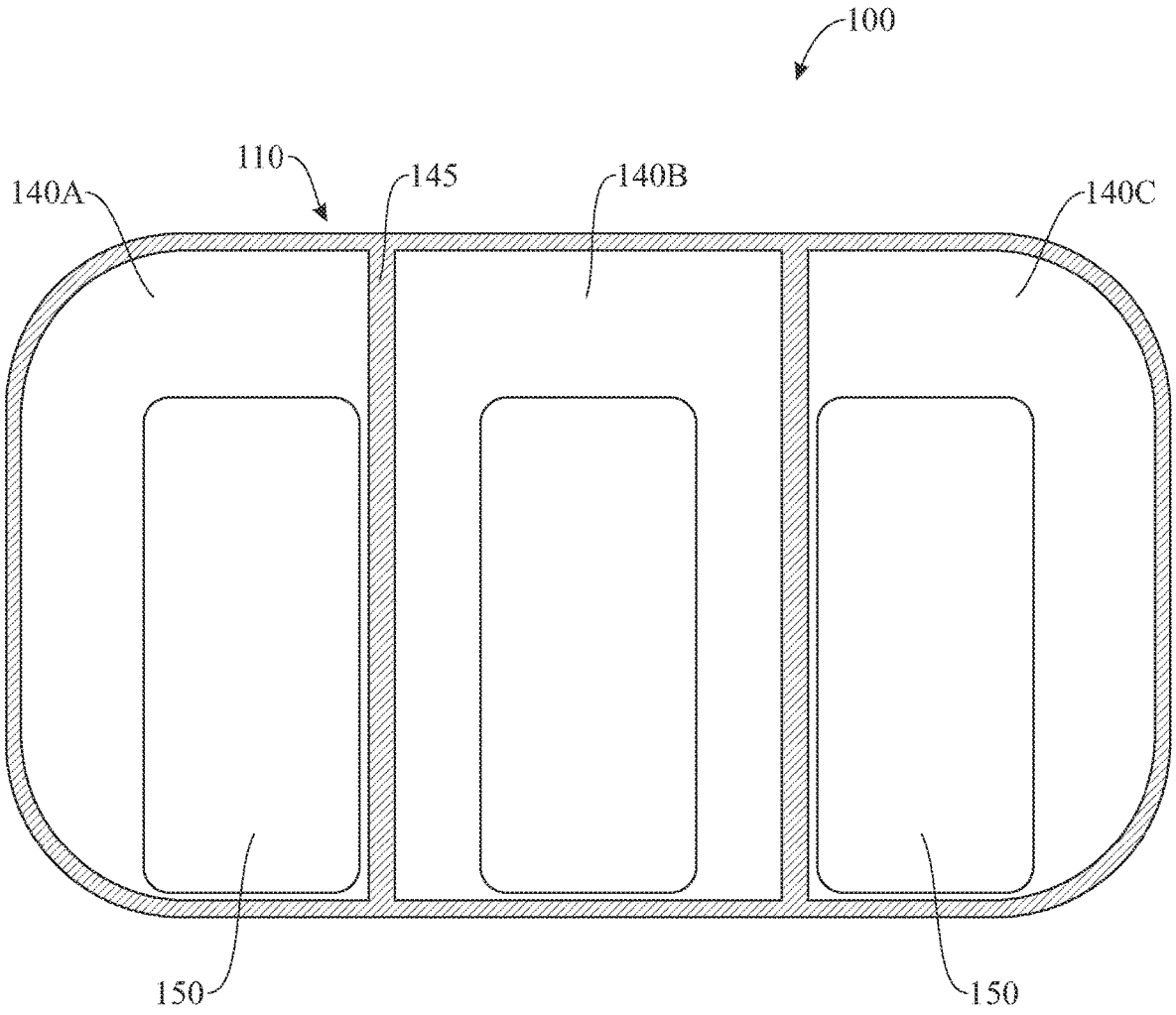
FIG. 5 is a cross sectional view of weighted device with a plurality of compartments comprising a plurality of pellet bags, in accordance with another embodiment of the present specification.

In some embodiments, the top portion 112 along with the central portion 114 and the bottom portion 116 define a compartment of the container 110 (best seen in FIGS. 4-5). The compartment of the container 110 allows one or more components, such as pellet bags, to be disposed therein, as will be described in detail further below.

In some embodiments, the top portion 112 is at least partially detachable from the central portion 114. In some embodiments, the top portion 112, when at least partially detached, defines an opening (not shown) of the container 110 that provides access to the compartment of the container 110. The opening may be utilized to gain access to the compartment, such as to place one or more components therein.

In some embodiments, the top portion 112 is coupled to the central portion 114 by means of a zipper 120. The zipper 120 is configured to be open in order to detach the top portion 112 at least partially from the central portion 114, and expose the opening of the compartment of the container 110. The zipper 120 is configured to be closed in order to close the opening of the compartment of the container 110.

Figure 3:
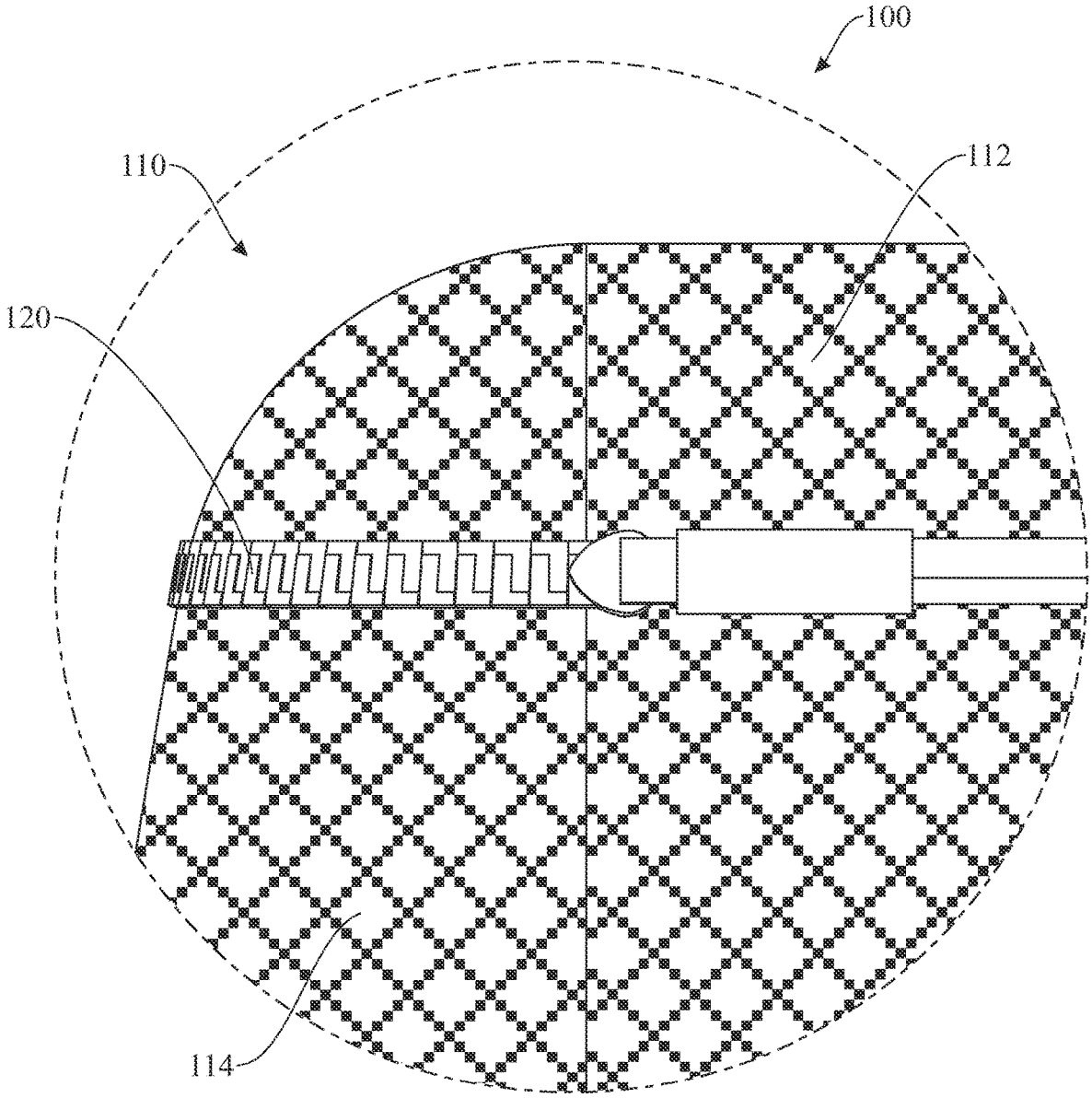
FIG. 3 is an enlarged view of a zipper on the weighted device taken from FIG. 2, in accordance with an embodiment of the present specification.

FIG. 3 illustrates a close-up view of the weighted device 100 in order to illustrate the zipper more clearly 120 and the container 110. The zipper 120 couples the top portion 112 to the central portion 114 in a detachable manner. A user may open or close the zipper 120 depending on the requirement to access the compartment of the container 110. In some embodiments, the zipper 120 may be configured to be covered by the top portion 112 and/or the central portion 114 so as to prevent scratching on external surfaces. As seen in FIG. 3, the top portion 112 and the central portion 114 are formed of a meshed material that allows liquid, such as water, to pass there through. Thus, the weighted device 100 when used under water will allows water to pass there through and when taken out of water, would provide adequate drainage for the water.

In some embodiments, as best seen in FIG. 2, the weighted device 100 comprises a fastening means 130 provided at a rear surface 114A of the central portion 114 of the container 110. The fastening means 130 may enable a user to secure the weighted device 100 on or around a body part, such as on a lap, around a waist, or around a leg.

Figure 7:
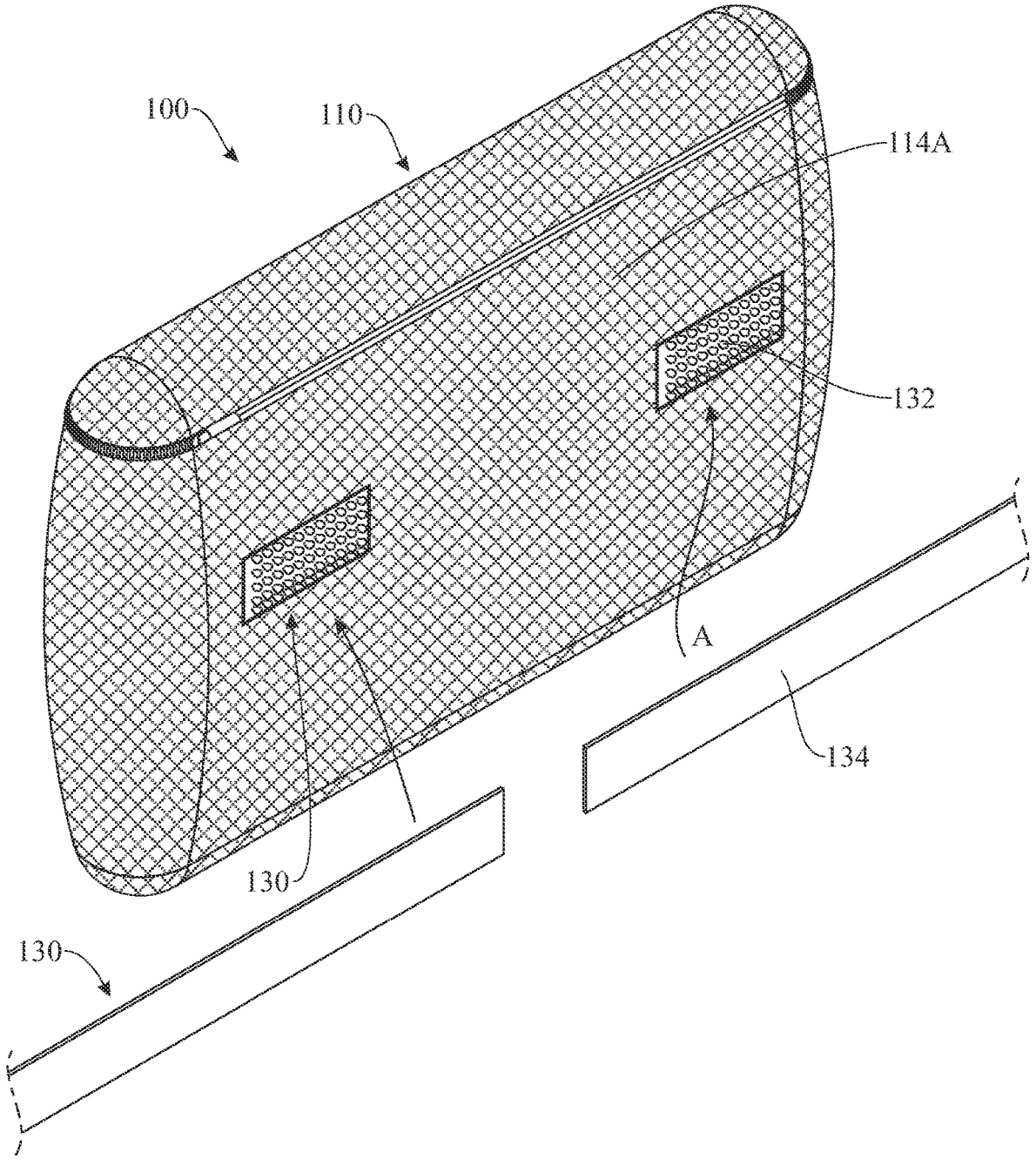
FIG. 7 is a rear perspective view of weighted device depicted a fastening means that is a strap or belt with a hook and loop closure system on the ends of the strap or belt, in accordance with another embodiment of the present specification.

In some embodiments, the fastening means 130 forms a hook portion 132 of a hook and loop attachment system, the hook portion being configured to engage with a loop portion the hook and loop attachment system, as would be apparent to a skilled person in view of the present disclosure. Reference is made to FIG. 7 which illustrates the fastening means 130 provided at the rear surface 114A of the central portion 114, in that, the hook portion 132 is being engaged with a loop portion 134. As shown by arrows A, the loop portion 134 can be engaged to the hook portion 132. A user may wrap a body part such as a waist or a leg, with the loop portion 134 and engage ends of the loop portion with the hook portion 132, thereby allowing the weighted device 100 to be worn by the user.

Reference is now made to FIG. 4 that illustrates a cross sectional or transparent side view of the weighted device 100 having pellet bags 150 disposed therein, in accordance with one embodiment of the present disclosure. The container 110 of the weighted device 100 comprises a single compartment 140 that provides a space for the pellet bags 150 to be disposed therein. It is appreciated that although in FIG. 4, the number of pellet bags 150 being shown is three, a different number of pellet bags 150 may be disposed in the container 110.

The pellet bags 150 may include a number of weights, such as beads or pellets, there within, thereby providing the pellet bag 150 with a specific weight. The weight of the pellet bags 150 would depend on the number of pellets being used to form the pellet bags 150. In some embodiments, the weight of each of the pellet bags 150 may be same. In some embodiments, the weight of individual pellet bags 150 may vary from each other. The pellet bag 150 may thus be considered as a bag having a specific weight. The number of pellet bags 150 in the container 110, and the individual weights of each of the pellet bags 150, define a weight of the weighted device 100.

In some embodiments, the pellets being used in the pellet bag 150 may be formed of a suitable material such as bismuth, lead, plastic, pewter, sea pearls, weighted pearls, and the like. In some embodiments, the pellet bags 150 may resemble a weight pouch. In some embodiments, the weight of a pellet bag 150 may be in the range of 9-25 lbs.

Reference is now made to FIG. 5 that illustrates a cross sectional or transparent side view of the weighted device 100 having pellet bags 150 disposed therein, in accordance with another embodiment of the present disclosure. The container 110 of the weighted device 100 comprises a plurality of compartments 140A, 140B, 140C, each providing a space for the pellet bags 150 to be disposed therein. It is appreciated that although in FIG. 5, the number of compartments being shown is three, a different number of compartments may be formed in the container 110.

The plurality of compartments 140A, 140B, 140C each provide a space for the pellet bags 150 to be disposed therein. The plurality of compartments 140A, 140B, 140C may be formed as a result of one or more dividers 145 being formed in the container 110. By virtue of the plurality of compartments, a desired weight distribution can be achieved, in that, the number and/or weight of the pellet bags 150 disposed in one of the plurality of compartments 140A, 140B, 140C may vary from the number and/or weight of the pellet bags 150 disposed in a different one of the plurality of compartments 140A, 140B, 140C.

Figure 6:
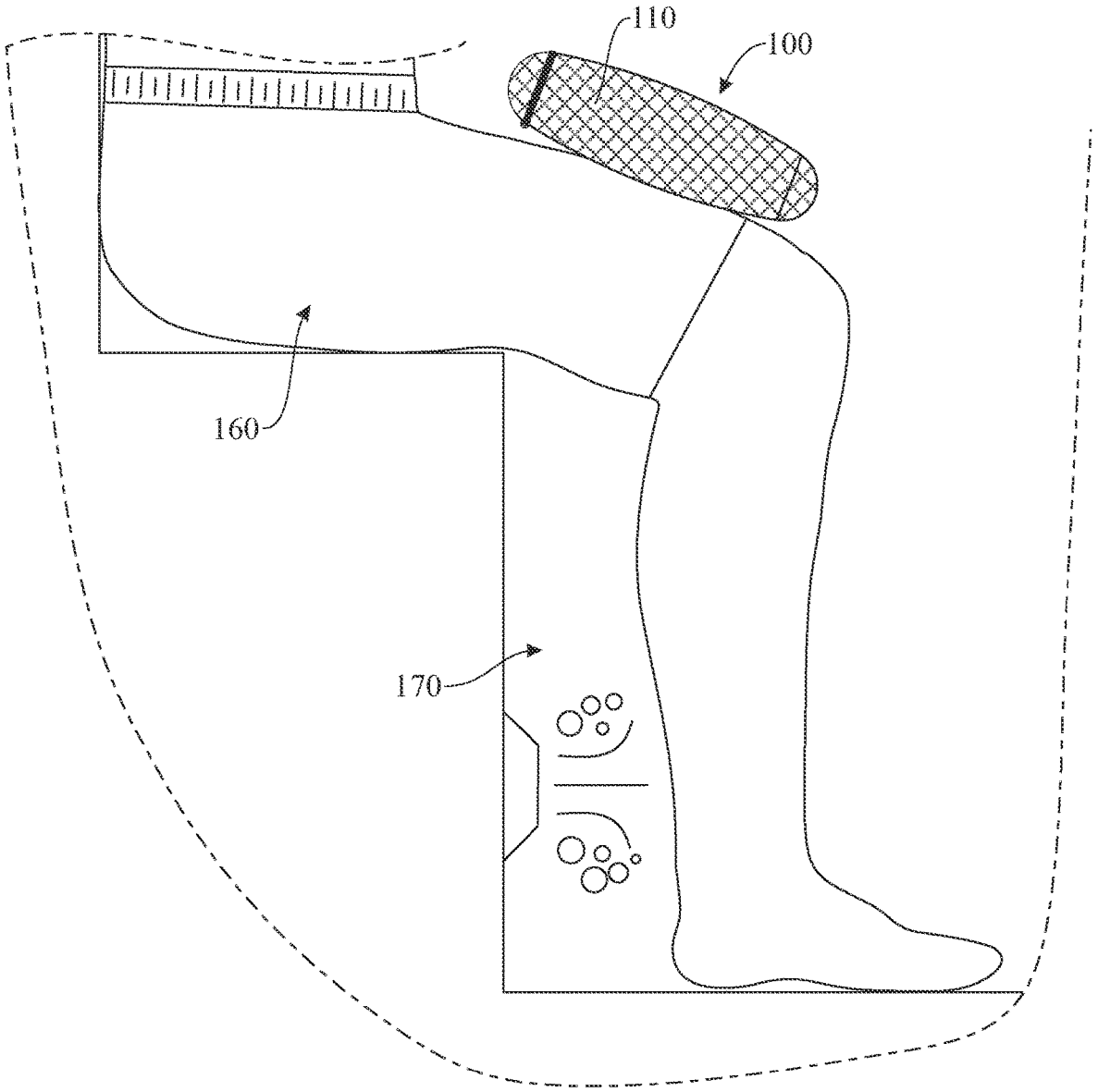
FIG. 6 is side elevation view of weighted device being used by a user, the weighted device being secured on a lap of the user, in accordance with one embodiment of the present specification.
Figure 8:
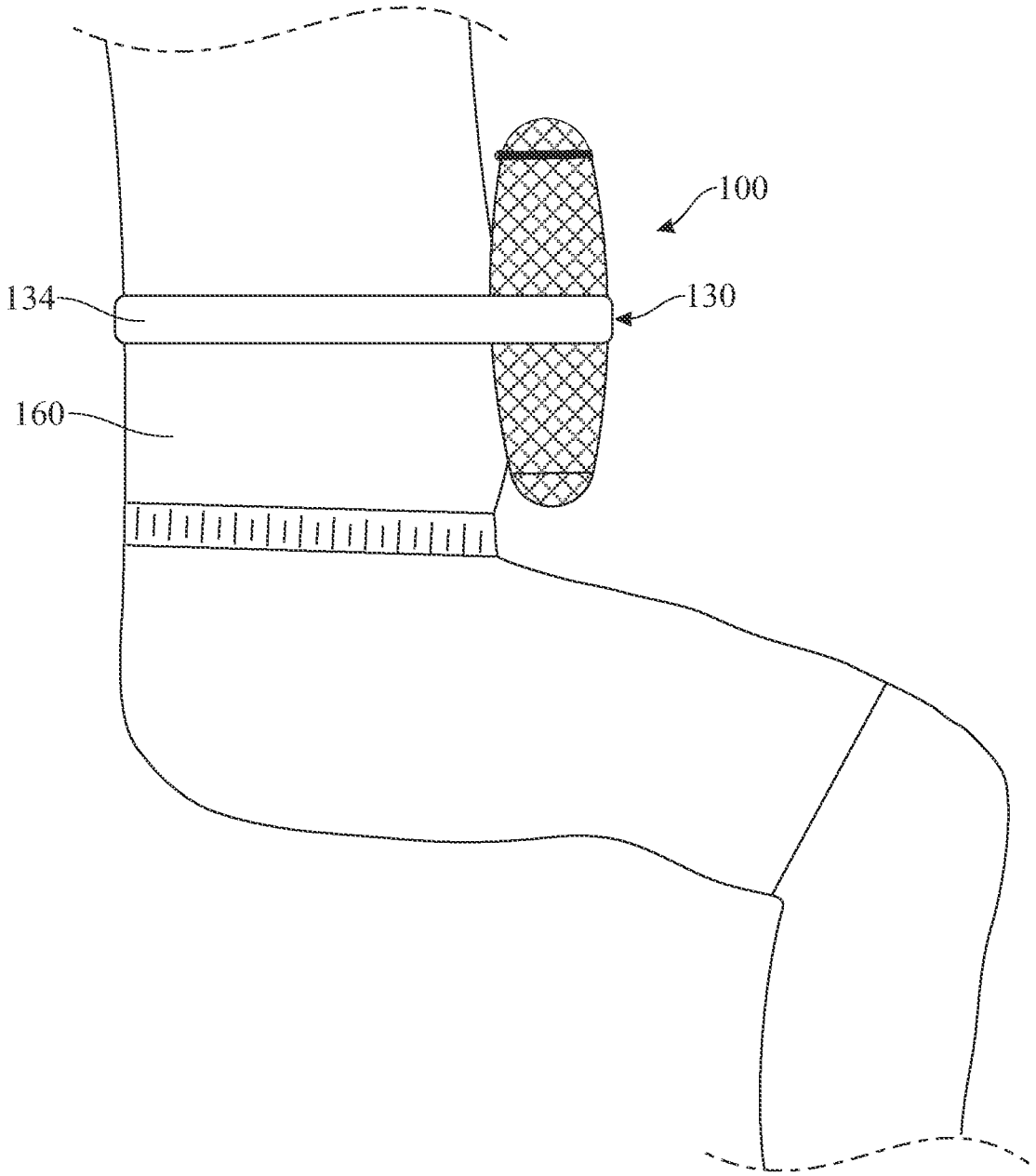
FIG. 8 is a side elevation view of the weighted device being used by a user, the weighted device being secured on a waist of the user, in accordance with an embodiment of the present specification.

Reference is made to FIGS. 6 and 8 that illustrate the weighted device 100 being used by a user 160 in a hot tub 170. As seen in FIG. 6, the weighted device 100 may be placed by the user 160 on a lap portion. In some embodiments, the weighted device 100 may be secured to the lap of the user 160, by virtue of the weight of the weighted device 100. In some embodiments, the weighted device 100 may be secured to the user, for instance, by means of fastening means 130 (not visible). In some embodiments, the weighted device 100 may be secured to the user 160 by means of hook and loop fastening system being wrapped around the thigh portion of the user 160.

As seen in FIG. 8, the weighted device 100 may be secured to a waist portion of the user 160 by means of the fastening means 130. In particular, the loop portion 134 of the fastening means 130 may be wrapped around a waist portion of the user 160 and connected at its ends to the hook portions 132 of the fastening means 130. In some examples, the weighted device 100 may be secured to the waist portion of the user 160 in cases where the user 160 is in a hot tub 170 with water level up to or over the waist portion of the user 160. In some examples, the weighted device 100 may be secured to the lap and/or leg portion of the user 160 in cases where the user 160 is in a hot tub 170 with water level around the legs of the user 160.

In use, the weighted device 100 adds weight to the user 160, specifically to a body part of the user 160, and counters the buoyancy or floating forces of water. When the user 160 is in a hot tub 170, the water in the tub tends to apply a buoyant force on the user 160. This causes the user 160 to float in the water. The weighted device 100 counters such buoyant force of the water and prevents the user 160 from floating in the water.

Buoyant forces generally causes problems for those suffering from pain issues, e.g., back pain, when the users are in tub of water. The weighted device 100 avoids making muscles very tight, such as bracing oneself with arms or bending legs to avoid floating. Absence of such a weighted device 100 aggravates or causes pain to users and put stress on users that make use of a hot tub 170 to relieve pain. The weighted device 100 thus prevents pain and stress on the users by preventing buoyancy and floating.

The weighted device 100 is easy and convenient to use by a user 160. The user may initially decide the weight of the weighted device 100. For instance, the user 160 may choose specific pellet bags 150 as per the desired weight and place the pellet bags 150 in the compartment of the container 110 of the weighted device 100. The user 160 may then secure the weighted device 100 at a body part by means of the fastening means 130. The user 160 may then sit in a hot tub 170 of water without worrying about buoyancy.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A weighted device for use by a person to prevent buoyancy in a hot tub comprising:

a container;

at least one pellet bag;

and a fastener, wherein said container is a pocket, envelope, bag, or sack formed of a mesh material, said container has an inside surface and an outside surface, said container comprises a plurality of compartments, said at least one pellet bag has a respective weight, said at least one pellet bag is reversibly disposable within one of the plurality of compartments such that a desired weight distribution is achieved by a number and/or weight of said at least one pellet bag disposed in different ones of the plurality of compartments, and said fastener for reversibly attaching or securing said container to said person, wherein the fastener comprises a strap or a belt with a hook and loop fastening system, wherein, the strap or belt is a strip of strong flexible material with a first end and a second end, the first end of said strap or belt has a plurality of hooks or a plurality of loops that are part of the hook and loop fastening system, the second end of the strap or belt has a plurality of hooks or a plurality of loops that are part of the hook and loop fastening system, and the outside surface of the container comprises a plurality of hooks or a plurality of loops that are part of the hook and loop fastening system.

2. A weighted device for use by a person to prevent buoyancy in a hot tub as recited in claim 1 wherein said at least one of the plurality of compartments further comprises: a top portion, a central portion, and a bottom portion, wherein, said top portion is partially detachable from said central portion so that when said top portion is partially detached from said central portion an opening is created that provides access to said container.

3. A weighted device for use by a person to prevent buoyancy in a hot tub as recited in claim 2 wherein said top portion is coupled to said central portion by a zipper, wherein, said zipper may be opened to provide access to said container and closed to seal off access to said container.

4. A weighted device for use by a person to prevent buoyancy in a hot tub as recited in claim 3 wherein said zipper has a protective cover that prevents said zipper from scratching other surfaces.

5. A process of using the weighted device for use by a person to prevent buoyancy in a hot tub as recited in claim 4 comprising the steps of:

a) obtaining said weighted device for use by the person to prevent buoyancy in the hot tub;

b) inserting said at least one pellet bag into said container;

c) fastening said weighted device for use by the person to prevent buoyancy in the hot tub to a user; and d) said user entering said hot tub.

6. A process of using the weighted device for use by a person to prevent buoyancy in a hot tub as recited in claim 2 comprising the steps of:

a) obtaining said weighted device for use by the person to prevent buoyancy in the hot tub;

b) inserting said at least one pellet bag into said container;

c) fastening said weighted device for use by the person to prevent buoyancy in the hot tub to a user; and d) said user entering said hot tub.

7. A process of using the weighted device for use by a person to prevent buoyancy in a hot tub as recited in claim 3 comprising the steps of:

a) obtaining said weighted device for use by the person to prevent buoyancy in the hot tub;

b) inserting said at least one pellet bag into said container;

c) fastening said weighted device for use by the person to prevent buoyancy in the hot tub to a user; and d) said user entering said hot tub.

8. A process of using the weighted device for use by a person to prevent buoyancy in a hot tub as recited in claim 1 comprising the steps of:

a) obtaining said weighted device for use by the person to prevent buoyancy in the hot tub;

b) inserting said at least one pellet bag into said container;

c) fastening said weighted device for use by the person to prevent buoyancy in the hot tub to a user; and d) said user entering said hot tub.

9. A process of using the weighted device for use by a person to prevent buoyancy in a hot tub as recited in claim 1 comprising the steps of:

a) obtaining said weighted device for use by the person to prevent buoyancy in the hot tub;

b) inserting said at least one pellet bag into said container;

c) fastening said weighted device for use by the person to prevent buoyancy in the hot tub to a user; and d) said user entering said hot tub.

10. A process of using a weighted device to prevent buoyancy in a hot tub, said process comprising:

providing said weighted device comprising a container, at least one pellet bag; and a fastener;

wherein said container is a pocket, envelope, bag, or sack formed of a mesh material, said container has an inside surface and an outside surface, and said container comprises a plurality of compartments;

wherein said at least one pellet bag has a respective weight, said at least one pellet bag is reversibly disposed disposable within the plurality of compartments such that a desired weight distribution is achieved by a number and/or weight of said at least one pellet bag disposed in different ones of the plurality of compartments; and said process further comprising b) inserting said at least one pellet bag into at least one of the plurality of compartments;

c) fastening the weighted device to a user using via the fastener, wherein the fastener comprises a strap or a belt with a hook and loop fastening system; and d) using said weighted device to prevent buoyancy of the user in the hot tub.

* * * * *